United States Patent [19]

Sanderson et al.

[11] Patent Number: 4,905,336

[45] Date of Patent: Mar. 6, 1990

[54] MACHINE FOR LASTING SIDE PORTIONS OF SHOES

[75] Inventors: Alan Sanderson, Loughborough; Graham J. Mansfield, Bhakti, both of England

[73] Assignee: British United Shoe Machinery Ltd., Leicester, England

[21] Appl. No.: 315,424

[22] Filed: Feb. 24, 1989

[30] Foreign Application Priority Data

Mar. 3, 1988 [GB] United Kingdom ..... 8805135

[51] Int. Cl.[4] ..... A43D 21/18; A43D 21/00

[52] U.S. Cl. ..... 12/8.1; 12/12

[58] Field of Search ..... 12/12, 8.1, 12.4, 12.5, 12/10, 10.5, 54.3

[56] References Cited

U.S. PATENT DOCUMENTS

| | | | |
|---|---|---|---|
| 3,205,516 | 9/1965 | Wilisch | 12/8.1 |
| 4,462,132 | 7/1984 | Flanders | 12/10.1 |
| 4,593,423 | 6/1986 | Clarkson et al. | 12/12 |
| 4,728,378 | 3/1988 | Bianchi | 12/12 |

*Primary Examiner*—Steven N. Meyers

*Attorney, Agent, or Firm*—Owen J. Meegan

[57] ABSTRACT

The machine comprises a shoe support (10) and two side lasting instrumentalities (20), each of which comprises a fluid bag assembly (40) which, in a tilted position (determined by an abutment 44), is moved into engagement with a shoe, whereafter, by continued inward movement, the bag assemblies (40) are caused to pivot (or roll) upwardly and over the shoe bottom edge, thus to urge the shoe upper around the feather edge of the last and against the insole. The bag assemblies are inflatable, a higher air pressure being applied, so as to apply bedding pressure to the lasting margin, after the assemblies (40) have moved fully inwardly.

12 Claims, 3 Drawing Sheets

MACHINE FOR LASTING SIDE PORTIONS OF SHOES

BACKGROUND OF THE INVENTION

This invention is concerned with a machine for lasting side portions of shoes.

Conventionally such machines comprise a shoe support for supporting a shoe comprising an upper on a last and an insole on the last bottom, together with two side lasting instrumentalities arranged one at each side of the shoe support. In operation, the side lasting instrumentalities are moved to engage the side portions of the shoe and complete the side lasting operations simultaneously, or substantially so. Such side lasting instrumentalities are of relatively complicated construction, bearing in mind the need which is frequently recognised to draw the upper tightly to the last prior to securing the lasting marginal portions of the upper to corresponding marginal portions of the insole on the last bottom.

In many instances, however, after the toe end and heel seat of a shoe have both been lasted, so that the upper is already tightly drawn over the last, especially in a direction extending lengthwise of the last, but also transversely thereof, the side lasting requirement is merely to lay the upper over the insole edge without any significant drafting of the upper other than is sufficient to ensure that no creases or significant "bagging" result in the finished shoe. For such an operation, it will be appreciated, side lasting machines of the complicated construction currently available are not usually required.

Furthermore, even in a so-called heel seat and side lasting machine, which is arranged for operations on shoes which have already been toe-lasted, once the upper has been correctly located on the upper for the heel seat lasting operation, again in many instances the need for the relatively complicated construction of side lasting instrumentalities currently available does not arise.

OBJECT OF THE INVENTION

It is thus the object of the present invention to provide an improved side lasting machine, or heel seat and side lasting machine, having side lasting instrumentalities which are of a simple construction, but which are nevertheless sufficient to ensure a satisfactory side lasting operation without creasing or significant "bagging" of the shoe upper.

SUMMARY OF THE INVENTION

The invention thus provides a machine for lasting side portions of shoes comprising a shoe support for supporting a shoe comprising an upper on a last and an insole on the last bottom, and two side lasting instrumentalities arranged one at each side of the shoe support, wherein each side lasting instrumentality comprises a fluid bag assembly mounted both for movement towards and away from the shoe support and for rocking movement about two axes, a first of which extends lengthwise of a shoe supported by the shoe support and the second heightwise thereof, said assembly including a rigid support frame portion having a generally L-shaped cross-section, biassing means for biassing the support frame portion to a tilted position about said first axis, fluid pressure operated drive means for moving the bag assembly towards and away from the shoe support, and regulator means for regulating the pressure of fluid supplied to the drive means, the arrangement being such that, with a first, lower, fluid pressure applied, the drive means causes the bag assembly, with the support frame portion in its tilted position, to be moved into engagement with a shoe supported by the shoe support, such engagement taking place in the feather line region of the shoe, and the bag assembly being caused to pivot about its second axis to accommodate to the side contour of the shoe, and thereafter, with a second, higher, fluid pressure applied, the support frame portion is caused to rock about its first axis out of its tilted position, thus to cause the bag assembly to urge the shoe upper progressively about the feather edge and over the insole and to press lasting marginal positions of the upper against corresponding marginal portions of the insole whereby, with adhesive disposed therebetween, said marginal portions are bonded together.

It will thus be appreciated that the machine in accordance with the invention is of a relatively simple construction, the fluid bag assembly ensuring that, because of its flexibility, the shoe upper is engaged along the whole of each side portion thereof under a uniform pressure and can thus be urged against the sides of the last and over the insole, and lasting marginal portions thereof can be pressed against corresponding marginal portions of the insole, while avoiding the formation of creases in the upper and of any significant "bagging" thereof.

In a preferred embodiment of the invention, the fluid bag assembly comprises a bag supported by the support frame portion, means for supplying fluid under pressure to the bag, and further regulating means for regulating the pressure of fluid supplied, the arrangement being such that the pressure is switched from a lower to a higher level after the shoe upper has been urged over the insole as aforesaid, thus to apply a bedding pressure to the lasting marginal portions of the upper and corresponding marginal portions of the insole. Preferably, furthermore, the means for supplying fluid under pressure to the bag comprises means for connecting said bag to a source of air under pressure.

It will thus be appreciated that, using such an arrangement the fluid bag assembly has the two functions of acting as a wiper arrangement and also itself acting to provide the bedding pressure. Furthermore, by the two-pressure arrangement for the bag and also the two-pressure arrangement for the drive means, it will be clear that the initial stage of engaging the shoe upper can be done at relatively low pressures, thereby avoiding or reducing the risk of injury to the operator as the bag assembly engages the shoe.

Whereas the biassing means may comprise a suitable spring arrangement or the like, preferably it comprises a fluid pressure operated piston-and-cylinder arrangement having an operative condition in which an abutment carried by a piston rod thereof is engageable with the support frame portion of the bag assembly thus to hold said frame portion in its tilted position, the pressure of fluid supplied to said arrangement being greater than the lower pressure of the fluid supplied to the drive means. Conveniently, furthermore, the piston-and-cylinder arrangement of the biassing means is mounted for movement bodily with the bag assembly under the action of the drive means. By such an arrangement, the abutment remains in its desired position, which may e.g. be determined by one end position of the piston of the piston-and-cylinder arrangement, and thus also the fluid bag assembly is held in its tilted position, during the inward movement thereof towards the shoe support under the action of the drive means.

One advantage of the use of fluid pressure operated means for the biassing means, as opposed to a spring, is that, during the continued movement of the drive means under the second, higher, pressure as aforesaid, the fluid pressure applied to the piston-and-cylinder arrangement of the biassing means may be reduced or indeed discontinued at such time. In this way, the bag is released by the abutment, in order to be able to pivot, or to effect a rolling action, about the feather edge of the last and over the insole purely under the influence of the drive means, and of course in accordance with the geometry of its support. It will be appreciated that the fluid bag assembly is of course mounted in such a manner that the component of movement which is in a direction away from the shoe support, as it pivots as aforesaid, is compensated for by the inward movement of the drive means. Conveniently there is associated with the drive means adjustable stop means for determining the position to which the support frame portion, and thus the bag assembly, is pivoted out of its tilted position. Such adjustable stop means serves to hold the bag assembly in position during the application of bedding pressure, but also has a function of ensuring that, in pivoting as aforesaid, the support frame portion, and thus the bag assembly, does not enter a region in which the component of rearward movement away from the shoe support becomes significantly large in comparison with the amount of forward movement under the action of the drive means.

It will also be appreciated that for accommodating shoes of different sizes, some adjustment of the heightwise relationship between the shoe support and the side lasting instrumentalities may be considered desirable, and, in a preferred embodiment of the invention, means is provided for setting the heightwise position of the shoe support relative to the side lasting instrumentalities.

BRIEF DESCRIPTION OF THE DRAWINGS

There now follows a detailed description, to be read with reference with the accompanying drawings, of one side lasting machine in accordance with the invention. It will of course be appreciated that this machine has been selected for description merely by way of exemplification of the invention, and not by way of limitation thereof.

In the accompanying drawings.

DESCRIPTION OF THE PREFERRED EMBODIMENT

Figure 1:
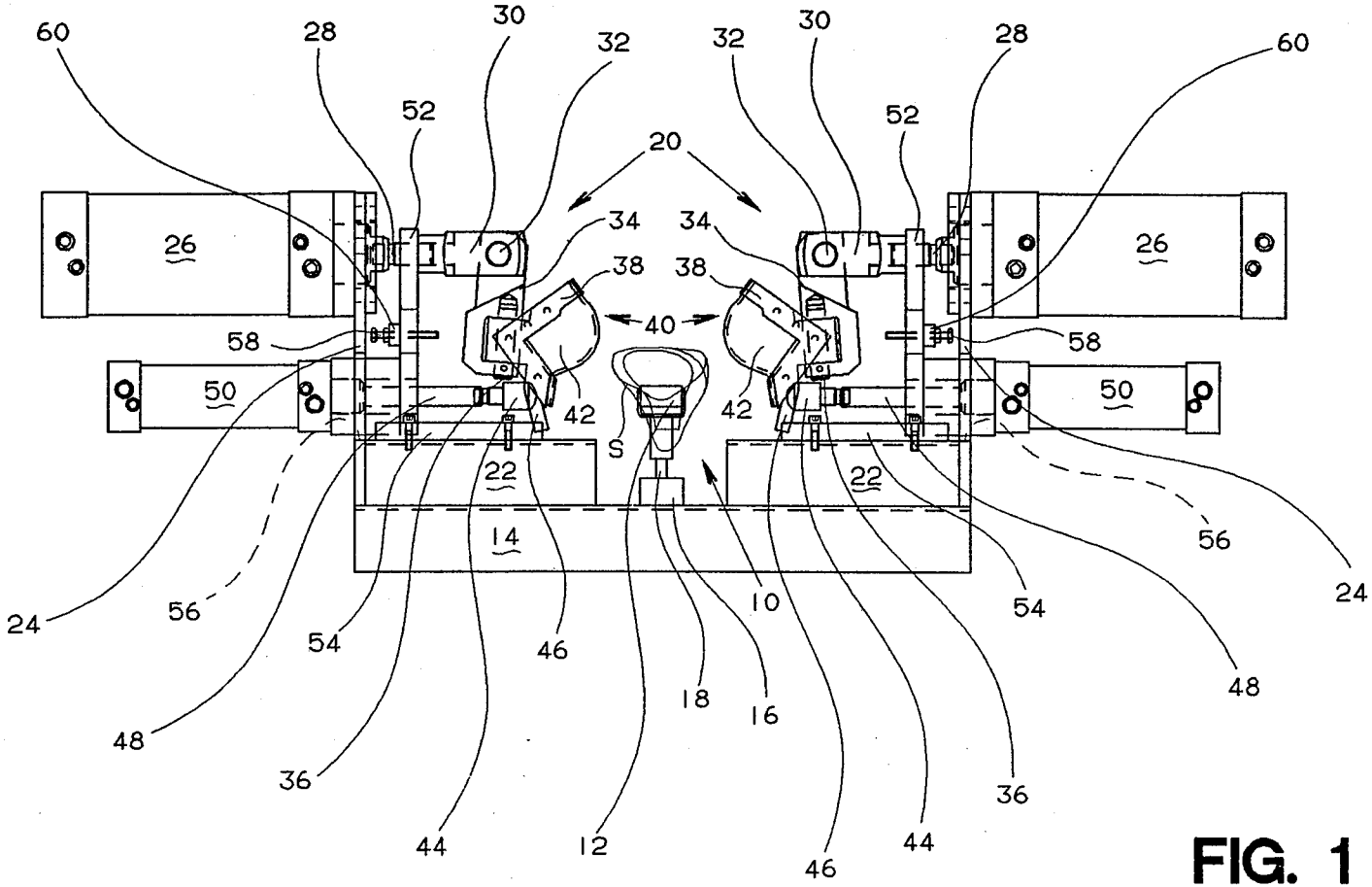
FIG. 1 is a general front view of the machine in accordance with the invention, showing the fluid bag assemblies thereof in a retracted position.

The machine now to be described is a machine for side lasting shoe uppers, but, it will be appreciated, this invention is also applicable to a combination machine in which the side lasting operation is combined with a heel seat lasting operation. The machine thus comprises a shoe support generally designated 10 itself comprising a heel pin (not shown) and a toe rest 12, for supporting, bottom uppermost, a shoe S, which comprises a shoe upper on a last and an insole on the last bottom, and at least the toe end of which has been lasted. The shoe support 10 is mounted on a frame portion 14 of the machine for heightwise adjustment therein, means, in the form of a rotatable collar 16 threadedly engaging a support 18 of the shoe support, being provided for varying the heightwise position of the shoe support thus to accommodate shoes of different sizes.

Mounted, one at either side of the shoe support 10, are two side lasting instrumentalities generally designated 20. These instrumentalities 20 are mirror-opposite, and thus the following description, while based upon one only, will refer to both.

Each instrumentality 20 comprises a base 22 secured to the frame 14 and carrying an upstanding support plate 24. At an upper end of the plate 24 is a piston-and-cylinder arrangment 26, constituting drive means for the side lasting assembly 20, a piston rod 28 of said arrangement extending inwardly towards the shoe support 10. A bifurcated block 30 is carried at the inward end of the piston rod 28 and supports, for pivotal movement about a pin 32 which extends in a direction generally lengthwise of the bottom of a shoe supported by the shoe support 10, a block 34 having a C-shaped lower section between the arms of which extends a further pivot pin 36, the axis of which extends generally heightwise of the bottom of a shoe supported by the shoe support 10. Secured on said pin 36 is a rigid support frame portion 38 forming part of a fluid bag assembly generally designated 40. Said bag assembly also comprises a membrane 42, which forms, within the support portion 38, an inflatable bag. It will thus be appreciated that the bag assembly 40 is pivotal about the axis 36, so that, by engagement with the side portion of a shoe, it can be accommodated to the side contour of such side portion, and also about the axis 32 for varying the angle of inclination of the bag assembly in relation to the shoe, as will be hereinafter described.

At the start of an operating cycle, the bag assembly is held in a tilted position, as shown in FIG. 1, by means of an abutment 44 engagable with a depending lug 46 of the support frame portion 38. The abutment 44 is carried at an inward end of a piston rod 48 of a piston-and-cylinder arrangement 50, itself carried on a support plate 52 which is connected to the piston rod 28 of the piston-and-cylinder arrangment 26 for movement therewith, the plate 52 being guided, at its lower end, in a guide 54 supported on the base 22, and the piston-and-cylinder arrangement 50 supported thereby passing through a bore 56 formed in the plate 24.

The support frame portion 38 of the bag assembly 40 extends lengthwise of the shoe and has a generally L-shaped cross-section. The membrane 42, which forms the bag, is sealingly secured to the outer ends of the "arms" of the L-shape and is also sealed to the frame portion 38 at the opposite ends thereof. The membrane 42, is made of any suitable flexible material, e.g. a neoprene rubber.

In the operation of the machine now to be described with reference to FIG. 3, a shoe is first placed on the shoe support 10 and the height thereof is so adjusted as to bring the shoe bottom to a pre-set datum in relation to the fluid bag assemblies 40. In this case, it has been found preferable that the "peak" portions of the shoe bottom, viz. the heel and ball regions, lie in a plane which is pre-set in relation to the bag assemblies 40, and to this end any suitable holddown means (not shown) may be provided. In this way, any need to tilt the bag assemblies 40 in a direction fore-and-aft of the machine to accommodate to the shoe bottom contour is avoided.

At this time air under mains pressure is supplied via pilot valve PVl to the upper end of the piston-and-cylinder arrangement 26, whereby the side lasting instrumentalities are held in their retracted condition. At the same time control valve CVI is de-actuated, whereby air under pressure is supplied (i) through throttle valve TV1 and valve V2 on the one hand and through valve V3 on the other to lower ends of piston-and-cylinder arrangements 50 whereby the abutments 44 are held in their advanced condition, holding the bag assemblies 40 in their tilted position, and (ii) via pilot valve PV2, to urge pilot valve PV3 into a position in which air under pressure, supplied through regulator valve RV1, via pilot valve PV4 and shuttle valve SV1, to the bag assemblies 40. A branch line L1 supplies air to pilot valve PV6, thereby prohibiting supply of air to the right hand side of pilot valve PV1; the latter however remains at this time in the position shown in FIG. 4. The pressure of air supplied to the bag assemblies 40 through regulator valve RV1 is of the order of 0.5 bar.

Figure 2A:
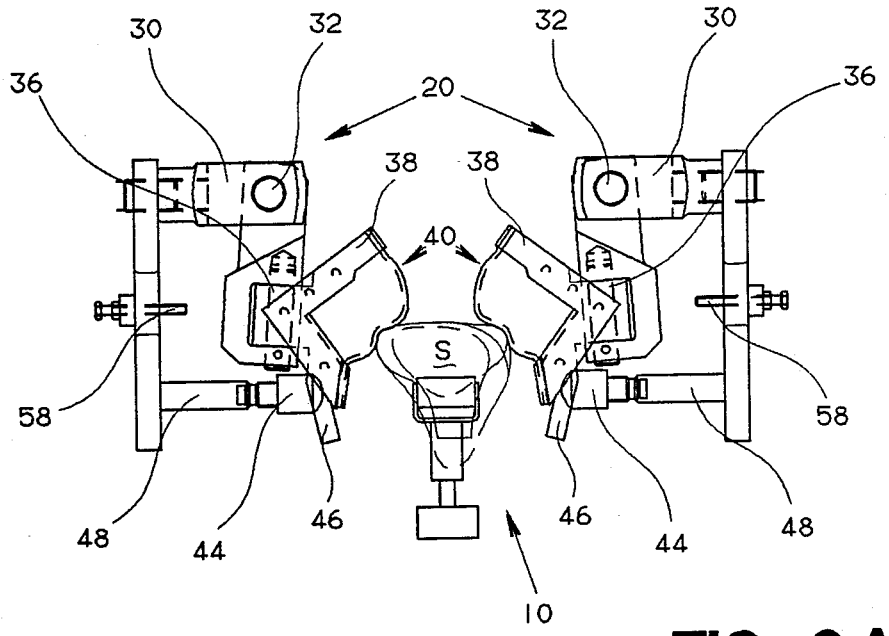
FIGS. 2A and 2B are fragmentary views showing the side lasting instrumentalities of the machine shown in FIG. 1, with the fluid bag assembly of each thereof respectively in engagement with the shoe at the end of a first stage of the operating cycle and at a further stage, viz. the end of their inward, pivoting (or rolling), movement, and prior to the application of bedding pressure.

With a shoe placed on the support 10 as aforesaid, treadle-operated valve V1 is actuated whereby pilot valve PV1 is switched, exhausting air from the upper end of the piston-and-cylinder arrangement 26 and, through regulator valve RV3, pilot valve PV5 and shuttle valve SV2, supplying air to the lower end of the piston-and-cylinder arrangements 26, whereby the bag assemblies, still held in their tilted position, are moved bodily inwards towards the shoe support. The pressure of the air as regulated by regulator valve RV3 is in the order of 0.6 bar, thus minimizing any risk of damage to the operator by the inward movement of the bag assemblies. This movement is terminated when each bag assembly engages the shoe. The height of the shoe support is such that engagement of the bag assemblies 40 with the shoe S takes place in the vicinity of the feather region of the shoe. This position is show in FIG. 2A. The insole of the shoe being operated upon may have been pre-treated with an adhesive coating along the marginal portions thereof. Alternatively, a cementing operation can now take place, e.g. using a hot-melt adhesive, along the side portions of the shoe; such cementing may be by hand, using any suitable hand-held gun, or automatically, e.g. using a system whereby nozzles are caused to apply a straight bead or line of adhesive to the insole along the side portions of the shoe one such system being described in GB-A2047577.

After cementing has been completed (or, in the case of a pre-cemented insole, after any necessary re-activation) the operator actuates valve CV1, which is lever-actuated, whereupon air under pressure is supplied to pilot valve PV5 whereby air, under pressure regulated by regulator valve RV4, is supplied to the lower end of the piston-and-cylinder arrangements 26. The pressure as regulated by regulator valve RV4 is in the order of 4.0 bar, so that the resistance to the inward movement of the bag assemblies 40 by engagement thereof with the shoe as aforesaid is overcome, and the pistons of said arrangements 26 are caused to effect a full stroke. At the same time, the air supplied to pilot valve PV3 is exhausted, but at this stage this valve does not shift its position. In addition, air is exhausted along line L2 from the bottom end of the piston-and-cylinder arrangements 50, the arrangement being such that air from the left-hand arrangement (viewing FIG. 4) is exhausted through the throttle valve TV1, while air is exhausted from the right-hand arrangement 50 without restriction. In this way, the left-hand bag assembly moves out of its tilted position relatively more slowly than the right-hand assembly. This is considered to be advantageous, especially in treating shoes which are of a pronouced asymmetrical bottom contour. For switching the operation of valves V2 and V3, so as to switch the comparative rates of exhaust from the arrangements 50 according to the hand of shoe being operated upon, valves V2 and V3 are linked and can be manually switched. In such a case, the exhausting of the left-hand arrangement 50 will be unrestricted, while that of the right-hand arrangement will be via throttle valve TV2.

Figure 2B:
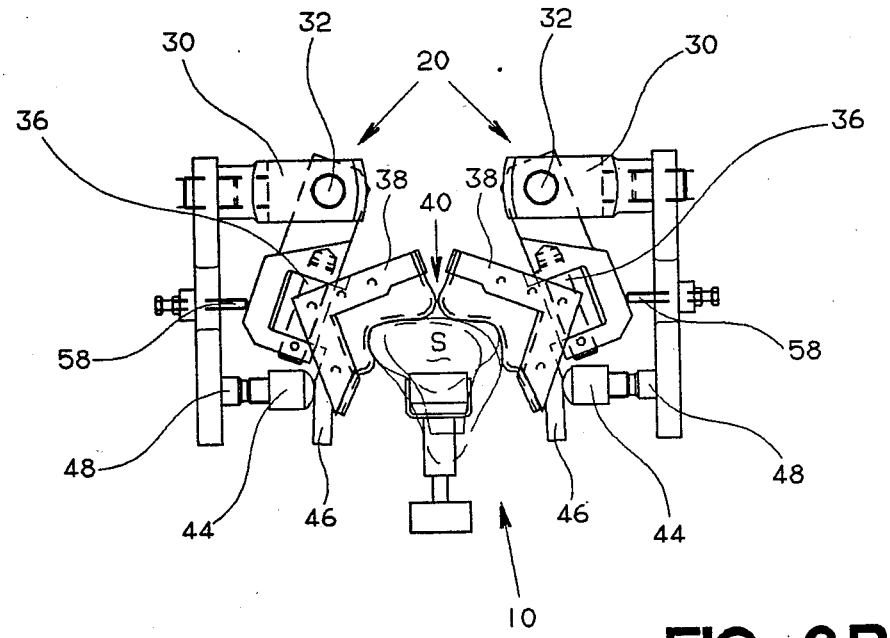

By this arrangement, as the bag assemblies 40 are moved inwardly as aforesaid, they are caused to pivot, each about its axis 32, the arrangement being such that the bags are therefore drawn upwardly in relation to the feather edge of the shoe bottom and over the insole, thereby urging the side portions of the shoe upper against the corresponding portions of the last. At the end of the inward stroke of the arrangements 26, the leading portions of the support frame portions 38 of the assemblies 40 are touching, or almost so: see FIG. 2B. This position of each support frame portion 38, and thus of its bag assembly 40, is determined by a stop member 58 which is carried on a cross-bar 60 mounted on the plate 52, said stop member 58 being engageable by rearward face of the block 34. The stop member 58 is adjustably positioned and is preferably set such that the amount of angular movement from the tilted position to such position is in the order of 35 degrees.

Actuation of valve CV1 also causes air to be supplied along branch line L3, through throttle valve TV3, to an accumulator A and thence to pilot valve PV7. This combination of throttle valve TV3 and accumulator A is such as to delay the piloting of pilot valve PV7 when the control valve CV1 is switched. Thus, the bag assemblies 40 are able to move into their position shown in FIG. 2B, and the abutments 44 are withdrawn, prior to actuation of pilot valve PV7. Upon actuation of the latter valve, air under pressure is applied to switch pilot valve PV4, whereupon air, under pressure regulated by regulator valve RV2, is supplied through shuttle valve SV1 and pilot valve PV3 to the bag assemblies. The regulated pressure is in the order of 3.0 bar.

The bag assemblies 40 are thus inflated to the higher pressure, whereby bedding pressure is applied to the lasting marginal portions of the shoe upper, which now overlie corresponding marginal portions of the insole, to press said marginal portions together and cause them to be bonded by the previously applied adhesive (cement).

In the machine described above and illustrated, the termination of the lasting operation is effected under the control of the operator, using release valve RLV1. It will of course be appreciated that in other apparatus it will be possible for the lasting operation to be terminated by any suitable timer means, which conventionally can be pre-set. Upon actuation of release valve RLV1

Figure 3:
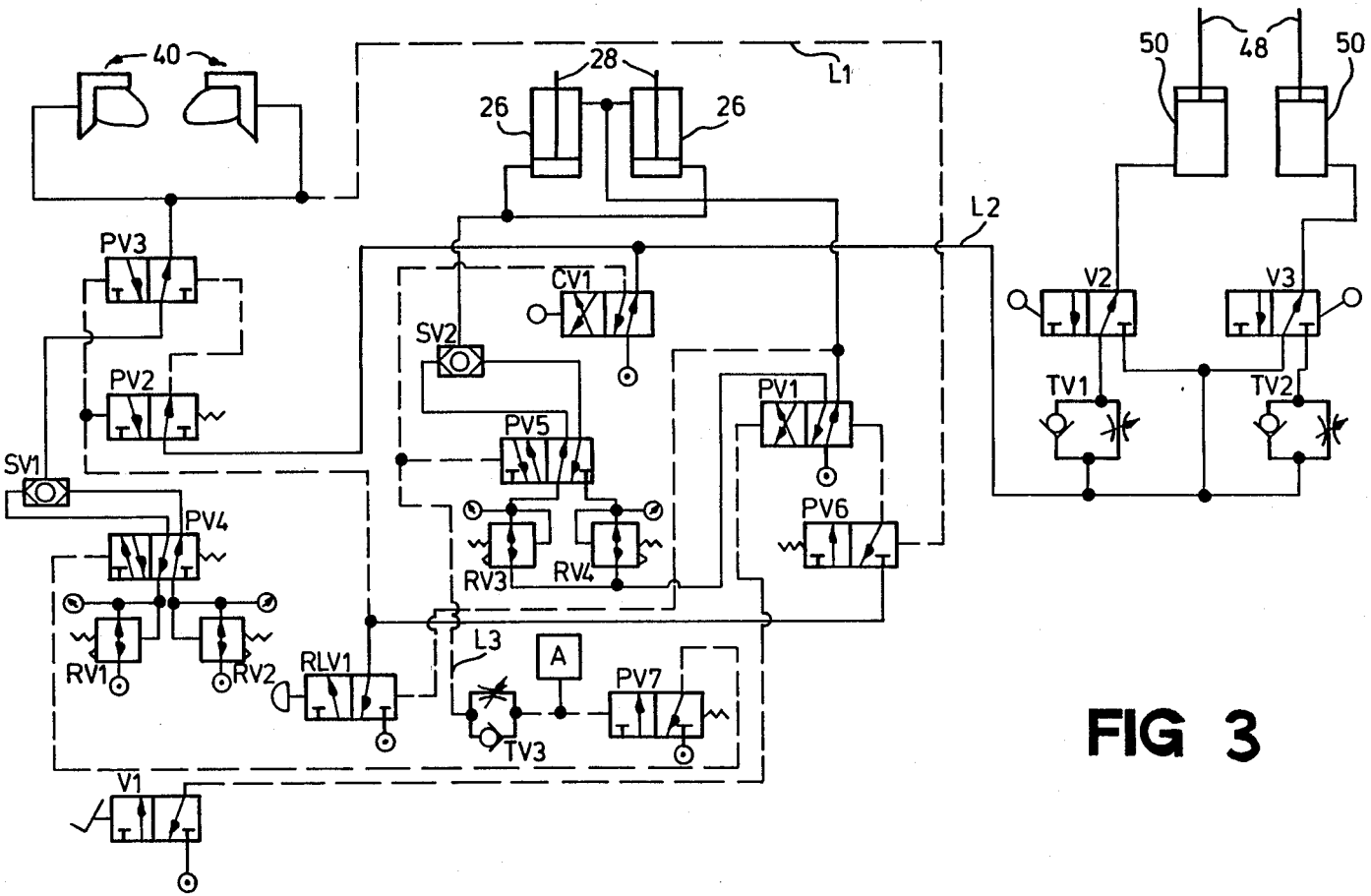
FIG. 3 is a schematic diagram of a pneumatic control circuit of the machine.

(i) air under pressure is supplied to pilot valves PV2 and PV3 thus causing the bag assemblies 40 to be exhausted, and also exhausting the pilot air from pilot valve PV6 along line L2, and (ii) air is also supplied through pilot valve PV6 to pilot valve PVI, switching it to its position shown in FIG.3. Switching valve PV1 is effective to cause air under pressure to be supplied to the upper end of piston-and-cylinder arrangements 26, the lower ends thereof being exhausted through shuttle valve SV2, pilot valve PV5 and regulator valves RV3, RV4.

In this way, the bag assemblies 40 are deflated and the side lasting instrumentalities are returned to their initial positions. At the same time, the operator can, by operation of valve CV1, returning it to its position shown in FIG. 3, cause the abutments 44 to be returned to their initial position, so that the bag assemblies are moved to their tilted positions. Although actuation of valve CV1 in this case is manual, it will be appreciated that it could also be effected automatically.

We claim:

1. A machine for lasting side portions of shoes comprising a shoe support for supporting a shoe comprising an upper on a last and an insole on the last bottom, and two side lasting instrumentalities arranged one at each side of the shoe support, wherein each side lasting instrumentality comprises a fluid bag assembly mounted both for movement towards and away from the shoe support and for rocking movement about two axes, a first of which extends lengthwise of a shoe supported by the shoe support and the second heightwise thereof, said assembly including a rigid support frame portion having a generally L-shaped cross-section, biassing means for biassing the support frame portion to a tilted position about said first axis, fluid pressure operated drive means for moving the bag assembly towards and away from the shoe support, and regulator means for regulating the pressure of fluid supplied to the drive means, the arrangement being such that, with a first, lower, fluid pressure applied, the drive means causes the bag assembly, with the support frame portion in its tilted position, to be moved into engagement with a shoe supported by the shoe support, such engagement taking place in the feather line region of the shoe, and the bag assembly being caused to pivot about its second axis to accommodate to the side contour of the shoe, and thereafter, with a second, higher, fluid pressure applied, the support frame portion is caused to rock about its first axis out of its tilted position, thus to cause the bag assembly to urge the shoe upper progressively about the feather edge and over the insole and to press lasting marginal positions of the upper against corresponding marginal portions of the insole whereby, with adhesive disposed therebetween, said marginal portions are bonded together.

2. A machine according to claim 1 wherein the fluid bag assembly comprises a bag supported by the support frame portion, means for supplying fluid under pressure to the bag, and further regulating means for regulating the pressure of fluid supplied, the arrangement being such that the pressure is switched from a lower to a higher level after the shoe upper has been urged over the insole as aforesaid, thus to apply a bedding pressure to the lasting marginal portions of the upper and corresponding marginal portions of the insole.

3. A machine according to claim 2 wherein the means for supplying fluid under pressure to the bag comprises means for connecting said bag to a source of air under pressure.

4. A machine according to claim 1 wherein the biassing means comprises a fluid pressure operated piston-and-cylinder arrangement having an operative condition in which an abutment carried by a piston rod thereof is engageable with the support frame portion of the bag assembly thus to hold said frame portion in its tilted position.

5. A machine according to claim 4 wherein the pressure of fluid supplied to the piston-and-cylinder arrangement of the biassing means is greater than the lower pressure of the fluid supplied to the drive means.

6. A machine according to claim 5 wherein the fluid pressure applied to the piston-and-cylinder arrangement of the biassing means is reduced when fluid under the second, higher, pressure is applied to the drive means.

7. A machine according to claim 5 wherein the application of fluid under pressure to the piston-and-cylinder arrangement of the biassing means is discontinued when fluid under the second, higher, pressure is applied to the drive means.

8. A machine according to claim 4 wherein the piston-and-cylinder arrangement of the biassing means is mounted for movement with the bag assembly under the action of the drive means.

9. A machine according to claim wherein adjustable stop means is provided for determining the position to which the support frame portion, and thus the bag assembly, is pivoted out of its tilted position.

10. A machine according to claim 1 wherein means is provided for selectively delaying the rocking movement of one of the bag assemblies, in relation to that of the other, about its first axis out of its tilted position.

11. A machine for lasting side portions of shoes comprising a shoe support for supporting a shoe comprising an upper on a last and an insole on the last bottom, and two side lasting instrumentalities arranged one at each side of the shoe support, wherein each side lasting instrumentality comprises a fluid bag assembly mounted both for movement towards and away from the shoe support and for rocking movement about an axis extending lengthwise of a shoe supported by the shoe support, said assembly including a rigid support frame portion having a generally L-shaped cross-section, and drive means for moving the bag assembly towards and away from the shoe support, the arrangement being such that the drive means causes the bag assembly to be moved into engagement with a shoe supported by the shoe support, such engagement taking place in the feather line region of the shoe, and thereafter to be rocked about its axis thus to cause the bag assembly to urge the shoe upper progressively about the feather edge and over the insole to press lasting marginal portions of the upper against corresponding marginal portions of the insole whereby, with adhesive disposed therebetween, said marginal portions are bonded together, wherein fluid under pressure is supplied to the fluid bag assembly, regulator means being provided for regulating the pressure of fluid thus supplied, and the arrangement being such that the pressure is switched from a lower to a higher level after the shoe upper has been urged over the insole as aforesaid, thus to apply a bedding pressure to the lasting marginal portions of the upper and corresponding marginal portions of the insole.

12. A machine for lasting side portions of shoes comprising a shoe support for supporting a shoe comprising an upper on a last and an insole on the last bottom, and two side lasting instrumentalities arranged one at each side of the shoe support, wherein each side lasting instrumentality comprises a fluid bag assembly mounted both for movement towards and away from the shoe support and for rocking movement about an axis, extending lengthwise of a shoe supported by the shoe support, fluid pressure operated drive means for moving the bag assembly towards and away from the shoe support, and regulator means for regulating the pressure of fluid supplied to the drive means, the arrangement being such that, with a first, lower, fluid pressure applied, the drive means causes the bag assembly to be moved into engagement with a shoe supported by the shoe support, such engagement taking place in the feather line region of the shoe, and thereafter, with a second, higher, fluid pressure applied, the bag assembly is caused to rock about its axis thus to cause the bag assembly to urge the shoe upper progressively about the feather edge and over the insole and to press lasting marginal positions of the upper against corresponding marginal portions of the insole whereby, with adhesive disposed therebetween, said marginal portions are bonded together.

* * * * *